US009393774B2

(12) United States Patent
Kim

(10) Patent No.: US 9,393,774 B2
(45) Date of Patent: Jul. 19, 2016

(54) SCREEN PRINTING APPARATUS AND SCREEN PRINTING METHOD USING THE SAME

(71) Applicant: Samsung Display Co., Ltd., Yongin, Gyeonggi-Do (KR)

(72) Inventor: Sung Woo Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 324 days.

(21) Appl. No.: 13/968,187

(22) Filed: Aug. 15, 2013

(65) Prior Publication Data

US 2014/0331874 A1 Nov. 13, 2014

(30) Foreign Application Priority Data

May 13, 2013 (KR) ..... 10-2013-0053939

(51) Int. Cl.
*B41F 15/42* (2006.01)
*B41F 15/46* (2006.01)
*B41F 15/08* (2006.01)

(52) U.S. Cl.
CPC ..... *B41F 15/42* (2013.01); *B41F 15/0818* (2013.01); *B41F 15/0881* (2013.01); *B41F 15/423* (2013.01); *B41F 15/46* (2013.01)

(58) Field of Classification Search
CPC .... B41F 15/46; B41F 15/423; B41F 15/0813; B41F 15/0818; B41F 15/42
USPC ..... 101/114, 123, 126, 129
See application file for complete search history.

(56) References Cited

U.S. PATENT DOCUMENTS

| | | | | |
|---|---|---|---|---|
| 5,287,806 | A * | 2/1994 | Nanzai | B23K 3/06 101/123 |
| 7,337,717 | B2 * | 3/2008 | Chen et al. | B41F 15/46 101/114 |
| 7,603,949 | B2 * | 10/2009 | Yuan | B41F 31/02 101/114 |
| 2010/0000428 | A1 * | 1/2010 | Chen | B41F 15/0818 101/123 |
| 2011/0219966 | A1 * | 9/2011 | Willshere | B41F 15/423 101/123 |
| 2012/0138664 | A1 * | 6/2012 | Sumioka | B41F 15/0881 228/102 |

FOREIGN PATENT DOCUMENTS

| | | | | |
|---|---|---|---|---|
| JP | 61-011255 | * | 1/1986 | B41F 15/42 |
| JP | 62-231754 | * | 10/1987 | B41F 15/40 |
| JP | 03-090356 | | 4/1991 | |
| JP | 06-191010 | * | 4/1994 | B41F 15/40 |
| JP | 09-123398 | * | 5/1997 | B41F 15/40 |
| KR | 97-0001675 | | 2/1997 | |
| KR | 10-2010-0136495 | | 12/2010 | |
| KR | 10-1036153 | | 5/2011 | |
| KR | 10-2012-0079278 | | 7/2012 | |

* cited by examiner

*Primary Examiner* — Blake A Tankersley
*Assistant Examiner* — Marissa Ferguson Samreth
(74) *Attorney, Agent, or Firm* — Innovation Counsel LLP

(57) ABSTRACT

A screen printing apparatus includes a print screen including a printed pattern through which an ink passes, a scraper that coats the ink on the print screen, a squeegee that makes contact with the print screen and pushes out the ink through the printed pattern. A control unit may control a transfer of the scraper. After the ink is coated on the print screen, a lower portion of the scraper is transferred to a direction, in which the squeegee is disposed, by the control unit and disposed on the squeegee. The apparatus helps avoid uneven distribution of that could result in undesirable "stains" on a substrate.

14 Claims, 6 Drawing Sheets

SCREEN PRINTING APPARATUS AND SCREEN PRINTING METHOD USING THE SAME

CROSS-REFERENCE TO RELATED APPLICATION

This U.S. non-provisional patent application claims priority under 35 U.S.C. §119 of Korean Patent Application No. 10-2013-0053939, filed on May 13, 2013, the content of which is hereby incorporated by reference in its entirety.

BACKGROUND

1. Field of Disclosure

The present disclosure relates to a screen printing apparatus and a screen printing method using the same.

2. Description of the Related Art

Electronic devices, such as a communication terminal, a digital camera, a notebook, a monitor, etc., often include a display device to provide a user interface.

The display device includes numerous layers of components, including a display panel that displays the image and a protective cover disposed on the display panel. In recent years, consumer demand has increased for a colored protective cover with various colors. The colored protective cover includes pearl particles that glitter to produce a sheen/effect that is desired by consumers.

The colored protective cover is prepared by printing a colored ink containing pearl particles on a substrate. As a printing method, screen printing method may be widely used.

The screen printing apparatus includes a scraper and a squeegee unit. The scraper deposits the ink onto a print screen that is placed on a substrate. The squeegee unit pushes the deposited ink in a predetermined direction such that the ink passes selectively through a print area of the print screen and lands on the substrate evenly.

SUMMARY

The present disclosure provides a screen printing apparatus capable of preventing a striped stain from appearing.

The present disclosure provides a screen printing method using the screen printing apparatus.

Embodiments of the inventive concept provide a screen printing apparatus a print screen including a print area through which ink passes, a scraper that provides the ink to the print screen, and a squeegee that contacts the print screen and pushes out the ink to print the ink through the print area. A lower portion of the scraper is configured to be in a first position for providing the ink to the print screen and a second position where ink would be intercepted by the squeegee before reaching the print screen.

The screen printing apparatus further includes first and second transfer units that move the scraper and the squeegee in an upper direction, a lower direction, a first direction, and a second direction opposite to the first direction in response to a signal from a control unit.

The scraper and the squeegee extend in a third direction crossing the first direction and are arranged to be spaced apart from each other, the first transfer unit is disposed at one end of the scraper and one end of the squeegee, and the second transfer unit is disposed at the other end of the scraper and the other one end of the squeegee.

The scraper and the squeegee are disposed at one end of the print screen by the first and second transfer units, the scraper is transferred in the lower direction to be disposed adjacent to the print screen by the first and second transfer units and the squeegee is transferred in the upper direction by the first and second transfer units.

The scraper and the squeegee are transferred to the other end of the print screen along the first direction by the first and second transfer units and the scraper deposits the ink on the print screen while being transferred along the first direction by the first and second transfer units.

After the ink is deposited on the print screen, the scraper is transferred in the upper direction at the other one end of the print screen by the first and second transfer units, the squeegee is transferred to the lower direction at the other one end of the print screen by the first and second transfer units to make contact with the print screen, and the lower portion of the scraper is transferred to the direction, in which the squeegee is disposed, by the control unit to be disposed on the squeegee.

The scraper and the squeegee are transferred to the one end of the print screen along the second direction by the first and second transfer units, the squeegee is transferred along the second direction to push out the deposited ink, and the ink passes through the print area.

The screen printing apparatus further includes a body, a first frame supporter disposed on one upper end of the body, a second frame supporter disposed on the other one upper end of the body, first and second frames extended in the first direction and arranged to be spaced apart from each other by a predetermined distance, and third and fourth frames extended in the third direction and arranged to be spaced apart from each other by a predetermined distance. One end of the first frame, one end of the second frame, and the third frame are disposed on the first frame supporter, the other one end of the first frame, the other one end of the second frame, and the fourth frame are disposed on the second frame supporter, the third frame is disposed between the one end of the first frame and the one end of the second frame, and the fourth frame is disposed between the other one end of the first frame and the other one end of the second frame.

The print screen may be disposed between the first frame supporter and the second frame supporter and between the first, second, third, and fourth frames.

The first transfer unit includes a first horizontal transfer part connected to an inner side surface of the first frame to move back and forth along the first direction and the second direction, a first support part connected to an upper portion of the one end of the scraper and a lower portion of the first horizontal transfer part, a first vertical transfer part connected to an upper portion of the first horizontal transfer part to transfer the first support part to the upper and lower directions, a second support part connected to an upper portion of the one end of the squeegee and the lower portion of the first horizontal transfer part, and a second vertical transfer part connected to the upper portion of the first horizontal transfer part to transfer the second support part to the upper and lower directions.

The second transfer unit includes a second horizontal transfer part connected to an inner side surface of the second frame to move back and forth along the first direction and the second direction, a third support part connected to an upper portion of the other one end of the scraper and a lower portion of the second horizontal transfer part, a third vertical transfer part connected to an upper portion of the second horizontal transfer part to transfer the third support part to the upper and lower directions, a fourth support part connected to an upper portion of the other one end of the squeegee and the lower portion of the second horizontal transfer part, and a fourth vertical transfer part connected to the upper portion of the second horizontal transfer part to transfer the fourth support part to the upper and lower directions.

The scraper includes a first scraper unit connected to the first support part and the third support part and extending in the lower direction, a second scraper unit connected to a lower portion of the first scraper unit and extending in the lower direction, and a rotation unit connected to an upper portion of the second scraper unit, and the ink is provided onto the print screen through a nozzle formed on a lower portion of the second scraper unit.

The squeegee includes a first squeegee unit connected to the first support part and the third support part and extending in the lower direction, and a second squeegee unit connected to a lower portion of the first squeegee unit and inclined at a predetermined angle while extending in the lower direction, and a lower portion of the second squeegee unit is disposed to be bent to a direction in which the scraper is disposed.

After the ink is deposited on the print screen, the first and second scraper units are transferred in the upper direction by the first and second transfer units, the first and second squeegee units are transferred in the lower direction by the first and second transfer units, the second squeegee unit makes contact with the print screen, the rotation unit rotates the second scraper unit to a direction, in which the second squeegee unit is disposed, by a predetermined angle, and the lower portion of the second scraper unit is disposed on an upper portion of the second squeegee unit.

Embodiments of the inventive concept provide a screen printing method includes providing a print screen having a pattern, disposing a scraper and a squeegee on the print screen, depositing ink on the print screen using the scraper, disposing a lower portion of the scraper on the squeegee, and placing the squeegee in contact with the print screen and pushing out the deposited ink through the pattern of the print screen.

The disposing of the scraper and the squeegee includes disposing the scraper and the squeegee at one end of the print screen, transferring the scraper to a lower direction to be disposed adjacent to the print screen, and transferring the squeegee to an upper direction.

The depositing of the ink on the print screen includes transferring the scraper and the squeegee to the other end of the print screen along a first direction and depositing the ink on the print screen as the scraper moves along the first direction.

The disposing of the lower portion of the scraper on the squeegee includes transferring the scraper in the upper direction at the other end of the print screen, transferring the squeegee in the lower direction to make contact with the print screen, and moving the lower portion of the scraper to a position in which scraper is disposed on the squeegee.

The depositing of the ink includes transferring the scraper and the squeegee to one end of the print screen along a second direction opposite to the first direction, pushing out the coated ink using the squeegee transferred along the second direction, and letting the ink flow through the pattern.

According to the above, the screen printing apparatus and the screen printing method using the screen printing apparatus may prevent the striped stain from being formed.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Hereinafter, the present invention will be explained in detail with reference to the accompanying drawings.

Figure 1:
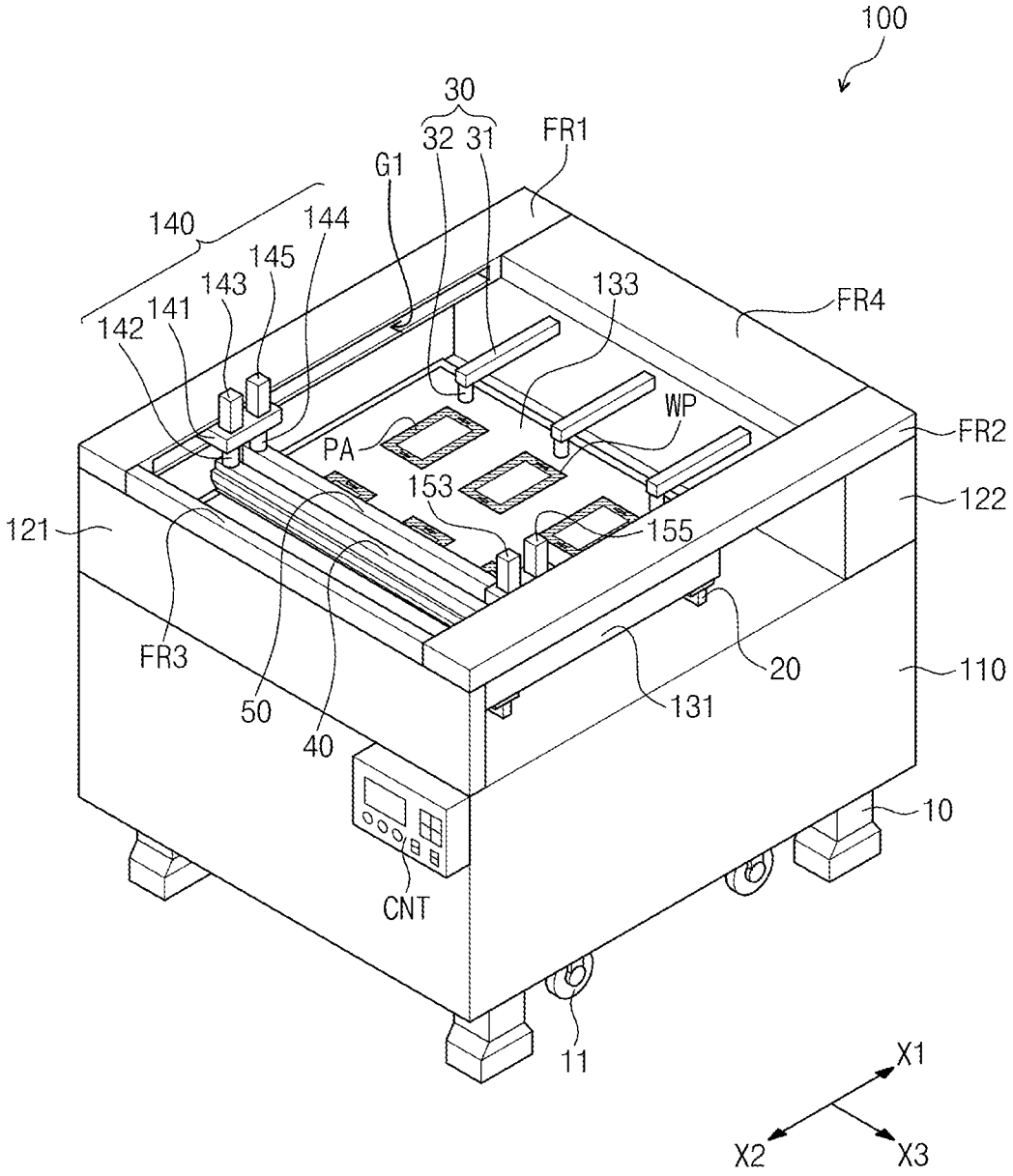
FIG. 1 is a perspective view showing a screen printing apparatus according to an exemplary embodiment of the present disclosure.
Figure 2:
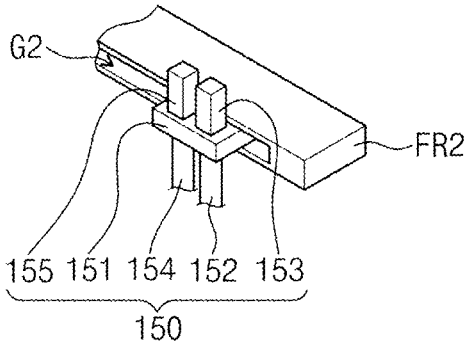
FIG. 2 is a perspective view showing a second heat unit disposed on an inner side surface of a second support frame shown in FIG. 1.
Figure 3:
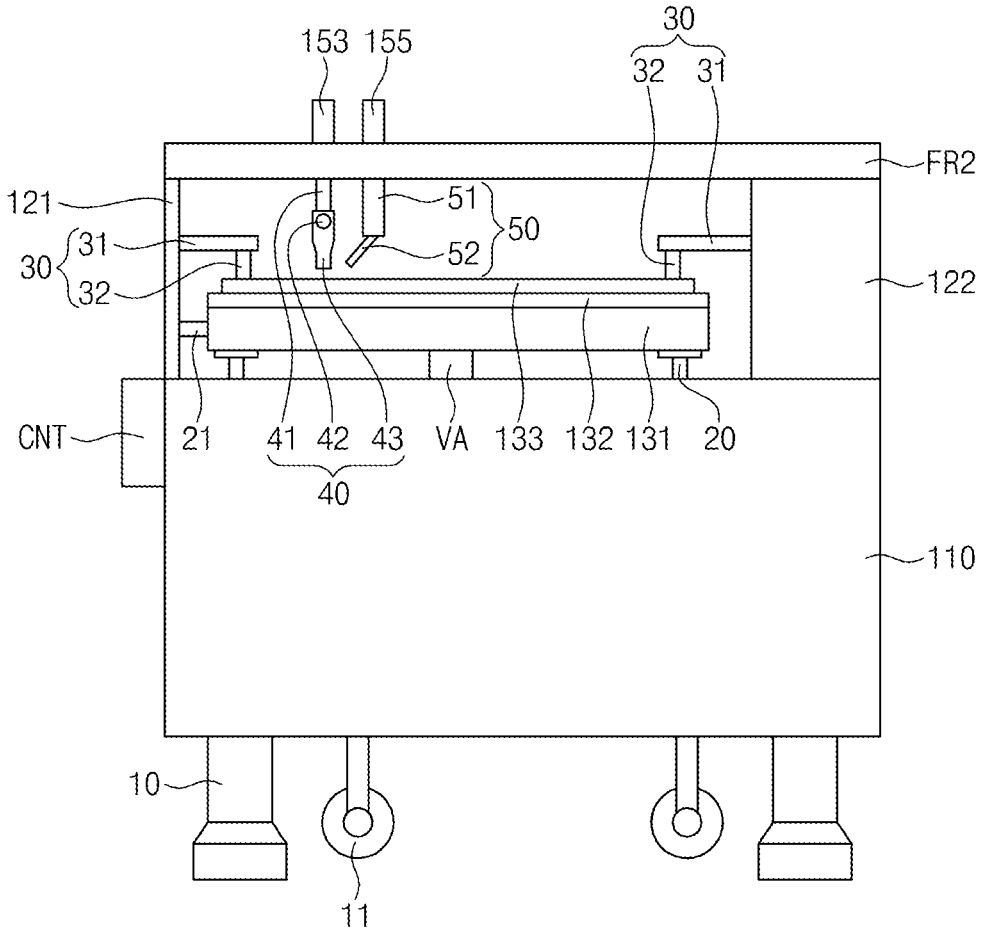
FIG. 3 is a side surface view showing the screen printing apparatus shown in FIG. 1.
Figure 4:
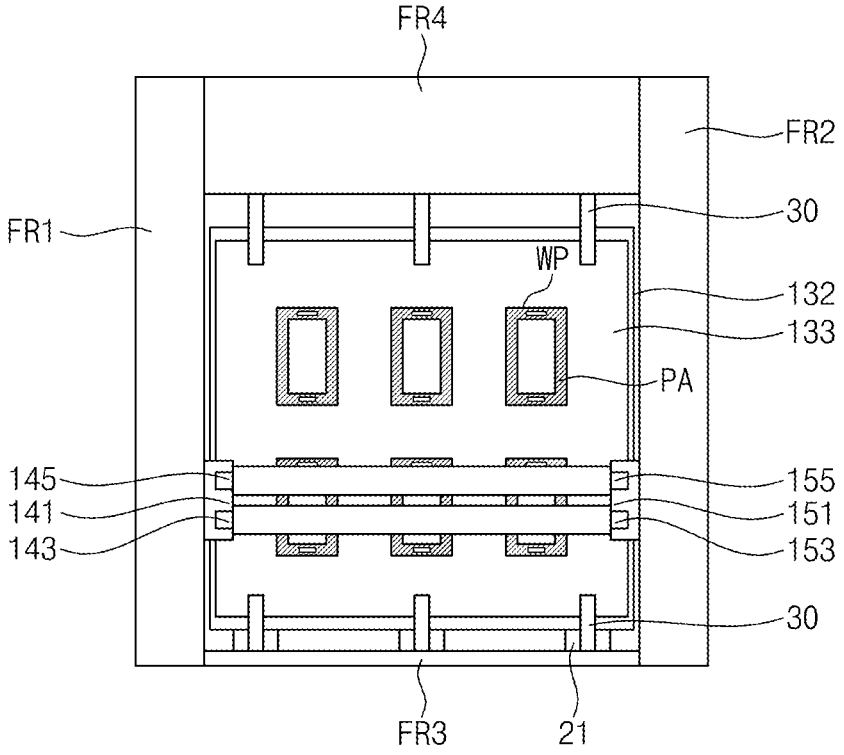
FIG. 4 is an upper plan view showing the screen printing apparatus shown in FIG. 1.

FIG. 1 is a perspective view showing a screen printing apparatus according to an exemplary embodiment of the present disclosure, FIG. 2 is a perspective view showing a second heat unit disposed on an inner side surface of a second support frame shown in FIG. 1, FIG. 3 is a side surface view showing the screen printing apparatus shown in FIG. 1, and FIG. 4 is an upper plan view showing the screen printing apparatus shown in FIG. 1.

Referring to FIGS. 1, 2, 3, and 4, a screen printing apparatus 100 includes a body 110, a control unit CNT, frame supporters 121 and 122, support frames FR1, FR2, FR3, and FR4, a printing table 131, a print screen 133, a first transfer unit 140, a second transfer unit 150, a plurality of screen supporters 30, a scraper 40, and a squeegee 50. The printing table 131 is configured to support a substrate 132 that will receive the ink to form a protective cover for a display.

The body 110 is connected to a plurality of body supporters 10 and a plurality of wheel units 11, which are disposed under the body 110. The body supporters 10 are capable of retracting (in an upward direction away from the ground) and extending out in a downward direction. Although not shown in figures, when the body supporters 10 are retracted, the wheel units 11 contact the ground, allowing the body 110 to be wheeled to a different location. When the body supporters 10 are extended, the wheel units 11 are lifted off the ground. Accordingly, the body 110 may be fixed in one location when the body supporters 10 are in extended positions.

The control unit CNT is disposed on one side surface of the body 100. The control unit CNT controls an operation of the screen print apparatus 100. For instance, the control unit CNT includes a start button and an end button and the screen print apparatus 100 starts or ends the operation thereof in response to the operation of the start and stop buttons. The control unit CNT may display a printed state. The control unit CNT controls an operation of the first and second transfer units 140 and 150 used to transfer the scraper 40 and the squeegee 50.

The frame supporters 121 and 122 are disposed on the body 110. The frame supporters 121 and 122 include a first frame supporter 121 and a second frame supporter 122. The first frame supporter 121 is disposed on an upper side portion of the body 110 and the second frame supporter 122 is disposed on the other upper side portion of the body 110.

The support frames FR1, FR2, FR3, and FR4 are disposed on the first and second frame supporters 121 and 122. The support frames FR1, FR2, FR3, and FR4 include a first support frame FR1, a second support frame FR2, a third support frame FR3, and a fourth support frame FR4.

The first and second support frames FR1 and FR2 extend in a first direction X1 and are arranged substantially parallel to each other while being spaced apart from each other. The third and fourth support frames FR3 and FR4 extend in a third direction X3 crossing the first direction X1, and are arranged substantially parallel to each other while being spaced apart from each other.

The third support frame FR3, one end of the first support frame FR1, and one end of the second support frame FR2 are disposed on the first frame supporter 121. The fourth support frame FR4, the other one end of the first support frame FR1, and the other one end of the second support frame FR2 are disposed on the second frame supporter 122.

The third support frame FR3 is disposed between the one end of the first support frame FR1 and the one end of the second support frame FR2. The third support frame FR3 is connected to an inner side of the ends of the first and second support frames FR1 and FR2.

The fourth support frame FR4 is disposed between the other end of the first support frame FR1 and the other end of the second support frame FR2. The fourth support frame FR4 is connected to an inner side of the other ends of the first and second support frames FR1 and FR2.

The printing table 131, the substrate 132, and the print screen 133 are disposed on the body 110. The printing table 131, the substrate 132, and the print screen 133 are disposed between the first frame supporter 121 and the second frame supporter 122 as shown in FIG. 3. In addition, the printing table 131, the substrate 132, and the print screen 133 are disposed between the first, second, third, and fourth support frames FR1, FR2, FR3, and in plan view as shown in FIG. 4.

The printing table 131 is disposed on a plurality of first table supporters 20 disposed on the body 110. The printing table 131 is supported by the first table supporters 20. One side surface of the printing table 131 is connected to a plurality of second table supporters 21 to be supported, which are connected to an inner side surface of the first frame supporter 121.

An absorption valve VA is connected to a center portion of the printing table 131. The absorption valve VA is disposed between the center portion of the printing table 131 and the body 110 and connected to the center portion of the printing table 131 and the body 110. Although not shown in the figures, the absorption valve VA is connected to a hole formed through the center portion of the printing table 131.

The substrate 132 is disposed on the printing table 131. The substrate 132 may be a glass layer that will be disposed on a display panel to protect the display panel.

The absorption valve VA generates an absorption force by an absorption device (or a vacuum pump) disposed inside the body. For instance, the inside of the absorption valve VA is maintained in a vacuum state by the absorption device. Due to the absorption force generated through the absorption valve VA, the substrate 132 is fixed in position on the printing table 131.

The print screen 133 is disposed on the substrate 132. The print screen 133 includes a printed pattern through which an ink passes. In detail, the print screen 133 may include a window pattern WP used for a mobile terminal as shown in FIG. 1. The ink selectively passes through a printing area PA of the window pattern WP and does not pass through a remaining area of the print screen 133.

The screen supporters 30 are connected to the inner side surface of the first frame supporter 121 and the inner side surface of the second frame supporter 122. The screen supporters 30 are disposed at both sides of the print screen 133 while being disposed on the print screen 133. The screen supporters 30 make contact with the print screen 133 at both sides of the print screen 133 to hold the screen supporters 30.

Each of the screen supporters 30 includes a first screen supporter 31 and a second screen supporter 32. The first screen supporters 31 are connected to the inner side surface of the first and second frame supporters 121 and 122. The first screen supporters 31 extend in a direction substantially vertical to the inner side surface of the first and second frame supporters 121 and 122.

The second screen supporters 32 are connected to a lower portion of the first screen supporters 31 and extend downward, toward the ground. The second screen supporters 32 contact the print screen 133 at both sides of the print screen 133 to hold the print screen 133.

The scraper 40 and the squeegee 50 are positioned not to overlap with the first support frame FR1 and the second support frame FR2. Accordingly, the scraper 40 and the squeegee 50, which extend in the third direction X3 when viewed in a plan view (referring to the coordinates of FIG. 1), are disposed between the first support frame FR1 and the second support frame FR2 as shown in FIG. 4.

The scraper 40 coats the ink on the print screen 133. The ink includes pearl particles that produce a type of reflectivity/sheen that users find desirable. The ink may be of a predetermined color.

The scraper 40 includes a first scraper unit 41, a rotation unit 42, and a second scraper unit 43. The first and second scraper units 41 and 43 extend in the third direction X3. The first scraper unit 41 extends downward, toward the ground. The second scraper unit 43 is connected to a lower portion of the first scraper unit 41 and extend downward as well. The rotation unit 42 is connected to an upper portion of the second scraper unit 43.

When the ink is coated on the print screen 133, the rotation unit 42 rotates the second scraper unit 42 by a predetermined angle toward the squeegee 50. The operation of the rotation unit 42 is controlled by the control unit CNT.

The ink is provided on the print screen 133 by the first and second scraper units 41 and 43. A lower portion of the second scraper unit 43 is configured to include a nozzle to spray the ink onto the print screen 133.

The squeegee 50 makes contact with the print screen 133 pushes out the ink that is deposited on the print screen 133 in a predetermined direction to print the ink on the substrate 132. The ink is deposited on selective parts of the substrate 132 through the printing area PA of the print screen 133.

The squeegee 50 includes a first squeegee unit 51 and a second squeegee unit 52. The first and second squeegee units 51 and 52 extend in the third direction X3. The first squeegee unit 51 extend downward.

The second squeegee unit 52 is connected to a lower portion of the first squeegee unit 51. The second squeegee unit 52 extends downward at a predetermined angle. For instance, the second squeegee unit 52 is arranged to allow a lower portion thereof to be bent toward the scraper 40.

The operation of the scraper 40 and the squeegee 50 will be described in detail with reference to FIGS. 5A to 5E.

The first and second transfer units 140 and 150 move the scraper 40 and the squeegee 50 to an upper direction, a lower direction, the first direction X1, and a second direction opposite to the first direction. The first transfer unit 140 is disposed on one upper end of the scraper 40 and one upper end of the squeegee 50, and the second transfer 150 is disposed on the other one upper end of the scraper 40 and the other one upper end of the squeegee 50.

In detail, the first transfer unit 140 is connected to the inner side of the first support frame FR1, the one upper end of the scraper 40, and the one upper end of the squeegee 50. The second transfer unit 150 is connected to the inner side of the second support frame FR2, the other upper end of the scraper 40, and the other upper end of the squeegee 50.

The first and second transfer units 140 and 150 may move back and forth along the first direction X1 and the second direction. Thus, the scraper 40 and the squeegee 50, which are connected to the first and second transfer units 140 and 150, may move back and forth along the first and second directions X1 and X2.

The first and second transfer units 140 and 150 may move up and down. Therefore, the scraper 40 and the squeegee 50, which are connected to the first and second transfer units 140 and 150, may move up and down.

The first transfer unit 140 includes a first horizontal transfer part 141, a first support part 142, a first vertical transfer part 143, a second support part 144, and a second vertical transfer part 145.

The first horizontal transfer part 141 is connected to the inner side surface of the first support frame FR1 and moves back and forth along the first and second directions X1 and X2. In detail, a predetermined area of the first horizontal transfer part 141 is inserted into a first groove G1 (see FIG. 1) formed in the inner side of the first support frame FR1. The first groove G1 extends in the first direction X1. The first horizontal transfer part 141 moves back and forth in the first and second directions X1 and X2 along the first groove G1.

A lower portion of the first support part 142 is connected to one upper end of the scraper 40. That is, the lower portion of the first support part 142 is connected to the one upper end of the first scraper unit 41 of the scraper 40. An upper portion of the first support part 142 is connected to a lower portion of the first horizontal transfer part 141.

The first vertical transfer part 143 is connected to an upper portion of the first horizontal transfer part 141. Although not shown in the figures, the first support part 142 may be connected to the first vertical transfer part 143 through a hole formed through the first horizontal transfer part 141. The first vertical transfer part 143 moves the first support part 142 up and down.

A lower portion of the second support part 144 is connected to an upper portion of the squeegee 50. In detail, the lower portion of the second support part 144 is connected to one upper end of the first squeegee unit 51 of the squeegee 50. The second support part 144 is connected to the lower portion of the first horizontal transfer part 141.

The second vertical transfer part 145 is connected to the upper portion of the first horizontal transfer part 141. Although not shown in the figures, the second support part 144 may be connected to the second vertical transfer part 145 through a hole formed through the first horizontal transfer part 141. The second vertical transfer part 145 moves the second support part 144 upward and downward.

The second transfer unit 150 includes a second horizontal transfer part 151, a third support part 152, a third vertical transfer part 153, a fourth support part 154, and a fourth vertical transfer part 155.

The second horizontal transfer part 151 is connected to the inner side surface of the second support frame FR2 and moves back and forth along the first and second directions X1 and X2. In detail, a predetermined area of the second horizontal transfer part 151 is inserted into a second groove G2 formed in the inner side of the second support frame FR2. The second groove G2 extends in the first direction X1. The second horizontal transfer part 151 moves back and forth in the first and second directions X1 and X2 in the second groove G2.

Although not shown in the figures, a transfer member may be disposed on inner sides of the first and second grooves G1 and G2 to transfer the first horizontal transfer part 141 and the second horizontal transfer part 151.

A lower portion of the third support part 152 is connected to the other upper end of the scraper 40. That is, the lower portion of the third support part 152 is connected to the other upper end of the first scraper unit 41 of the scraper 40. An upper portion of the third support part 152 is connected to a lower portion of the second horizontal transfer part 151.

The third vertical transfer part 153 is connected to an upper portion of the second horizontal transfer part 151. Although not shown in figures, the third support part 152 may be connected to the third vertical transfer part 153 through a hole formed through the second horizontal transfer part 151. The third vertical transfer part 153 moves up and down the third support part 152.

A lower portion of the fourth support part 154 is connected to the other upper portion of the squeegee 50. In detail, the lower portion of the fourth support part 154 is connected to the other upper end of the first squeegee unit 51 of the squeegee 50. The fourth support part 154 is connected to the lower portion of the second horizontal transfer part 151.

The fourth vertical transfer part 155 is connected to the upper portion of the second horizontal transfer part 151. Although not shown in figures, the fourth support part 154 may be connected to the fourth vertical transfer part 155 through a hole formed through the second horizontal transfer part 151. The fourth vertical transfer part 155 may move the fourth support part 154 up and down.

The scraper 40 and the squeegee 50 move back and forth along the first and second directions X1 and X3 by the first and second horizontal transfer units 141 and 151.

The first and third vertical transfer units 143 and 153 move the first and third support parts 142 and 152 up and down and are connected to the scraper 40. Thus, the scraper 40 may also move upward and downward.

The second and fourth vertical transfer units 145 and 155 upwardly and downwardly move the second and fourth support parts 144 and 154 and are connected to the squeegee 50. Thus, the squeegee 50 may upwardly and downwardly move.

FIGS. 5A to 5E are views showing an operation of the scraper and the squeegee shown in FIG. 1. For the convenience of explanation, only the printing table 131, the substrate 132, the print screen 133, the scraper 40, and the squeegee 50 have been shown in FIGS. 5A to 5E.

Figure 5A:
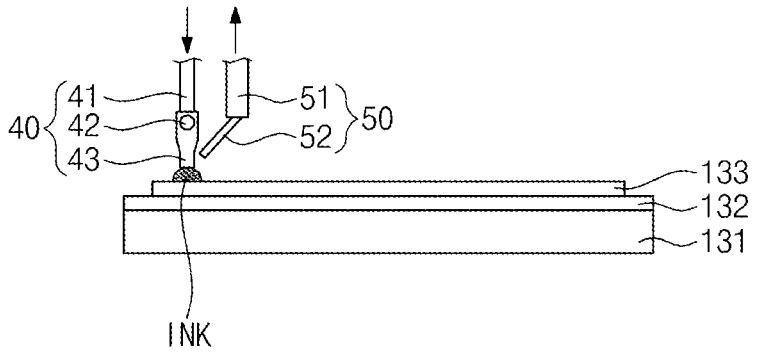
FIGS. 5A to 5E are views showing an operation of a scraper and a squeegee shown in FIG. 1.

Referring to FIG. 5A, the substrate 132 is disposed on and fixed to the printing table 131. The print screen 133 is disposed on the substrate 132.

The scraper 40 and the squeegee 50 are transferred by the first and second transfer units 140 and 150 and disposed on the one end of the print screen 133. In detail, the scraper 40 and the squeegee 50 are moved by the first horizontal transfer part 141 and the second horizontal transfer part 151 and disposed on the one end of the print screen 133.

The scraper 40 is moved downward by the first and second transfer units 140 and 150 and is disposed adjacent to the print screen 133. The scraper 40 sprays the ink INK onto the print screen 133. The squeegee 50 is moved upward by the first and second transfer units 140 and 150.

In detail, the first support part 142 and the third support part 152, which are connected to the first scraper unit 41 of the scraper 40, move downward by the first vertical transfer part 143 and the third vertical transfer part 153, and thus the scraper 40 also moves downward.

The second support part 144 and the fourth support part 154, which are connected to the first squeegee unit 51 of the squeegee 50, are moved upward by the second vertical transfer part 145 and the fourth vertical transfer part 155. Thus, the squeegee 50 moves upward.

Figure 5B:
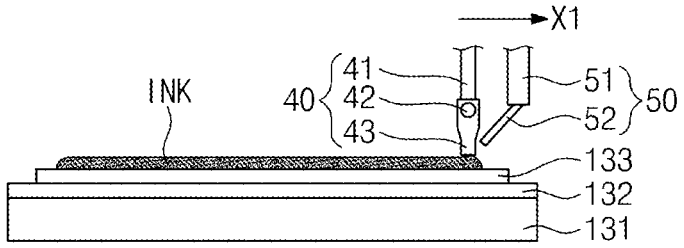

Referring to FIG. 5B, the scraper 40 and the squeegee 50 are transferred in the first direction X1 by the first and second transfer units 140 and 150 to be transferred to the other end of the print screen 133. In detail, the scraper 40 and the squeegee 50 are transferred in the first direction X1 by the first horizontal transfer part 141 and the second horizontal transfer part 151 to be transferred to the other end of the print screen 133.

The ink INK is uniformly coated on the print screen 133 by the scraper 40 that is transferred along the first direction X1.

Figure 5C:
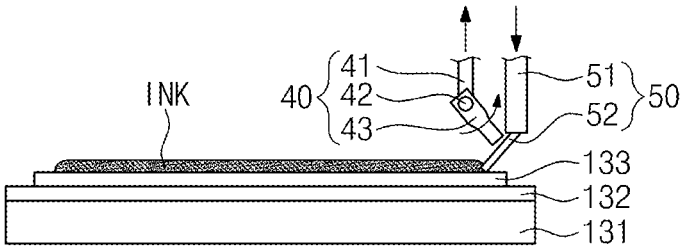

Referring to FIG. 5C, after the ink INK is deposited on the print screen 133, the scraper 40 is moved upward from the other end of the print screen 133 by the first and second transfer units 140 and 150. The squeegee 50 moves downwardly by the first and second transfer units 140 and 150 to make contact with the print screen 133.

The lower portion of the scraper 40 moves to the direction, in which the squeegee 50 is disposed, by the control of the control unit CNT and disposed on the squeegee 50. That is, the lower portion of the scraper 40 is transferred to the squeegee 50 and disposed to overlap with the lower portion of the squeegee 50.

In detail, the first support part 142 and the third support part 152 connected to the first scraper unit 41 of the scraper 40 are moved upward by the first vertical transfer part 143 and the third vertical transfer part 153. Thus, the scraper 40 may move upward as well.

The second support part 144 and the fourth support part 154 connected to the first squeegee unit 51 of the squeegee 50 are moved downward by the second vertical transfer part 145 and the fourth vertical transfer part 155. Thus, the squeegee 50 moves downward and the second squeegee unit 52 makes contact with the print screen 133.

The rotation unit 42 rotates the second scraper unit 43 by a predetermined angle, toward the second squeegee unit 52. The lower portion of the second squeegee unit 52 is disposed to be bent in the direction of the scraper 40. Therefore, the lower portion of the second scraper unit 43 is overlapped with the second squeegee unit 52 and disposed on the second squeegee unit 52.

Figure 5D:
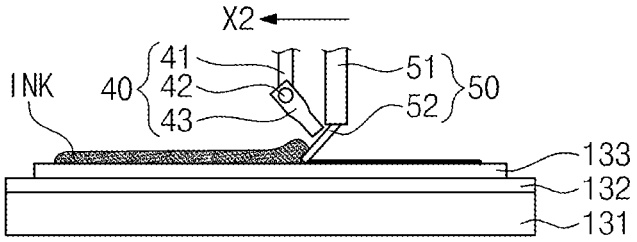
Figure 5E:
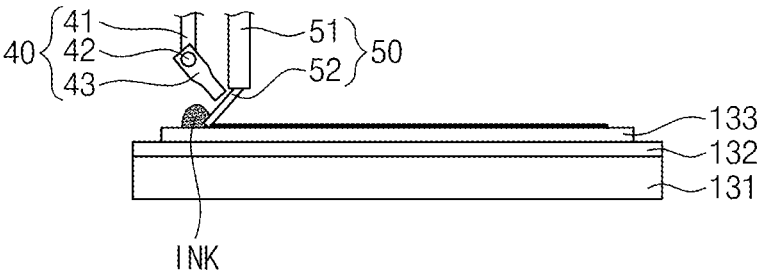

Referring to FIGS. 5D and 5E, the scraper 40 and the squeegee 50 are transferred in the second direction X2 by the first and second transfer units 140 and 150 to be close to the one end of the print screen 133. In detail, the scraper 40 and the squeegee 50 are transferred to the one end of the print screen 133 in the second direction X2 by the first and second transfer units 140 and 150.

The squeegee 50 pushes out the ink INK that is deposited on the print screen 133 while being transferred along the second direction X2. Particularly, the second squeegee unit 52 of the squeegee 50 is moved along the second direction X2 and pushes out the ink INK deposited on the print screen 133. Thus, the ink INK is printed onto the substrate 132 through the printed pattern of the print screen 133. That is, the ink INK selectively passes to the substrate 132 through the printing area PA of the print screen 133.

The printing operation may be performed by repeatedly performing the above-mentioned operations.

After the ink INK is coated, the scraper 40 moves only in the upward direction by the first and second transfer units 140 and 150. That is, the lower portion of the second scraper unit 43 may not be disposed on the upper portion of the second squeegee unit 52. In this case, a residual ink that remains on the nozzle of the lower portion of the second scraper unit 43 of the scraper 40 may be dropped on the print screen 133, and thus a contaminated area occurs, in which the residual ink is dropped.

When the residual ink is dropped onto the contaminated area of the print screen 133, an amount of the ink INK in the contaminated area is greater than an amount of the ink INK that is deposited on the part of the print screen 133 other than the contaminated area. That is, the ink INK is not coated uniformly on the print screen 133. This results in an uneven distribution of pearl particles, with more pearl particles being disposed in the contaminated area when compared to the other area of the printed area.

When the squeegee 50 pushes out the ink INK while being transferred to the one end of the print screen 133, a striped stain may form on the print screen 133 due to the ink INK being pushed out from the contaminated area including more pearl particles than other areas. That is, when the ink INK from the contaminated area, which has more pearl particles than other area, is pushed out to the one end of the print screen 133, a striped stain may undesirably form on the print screen 133.

The scraper 40 according to the present exemplary embodiment moves upward after the ink INK is deposited. In addition, the second scraper unit 43 is rotated to the direction of the second squeegee unit 52, by the rotation unit 42. The lower portion of the second scraper unit 43 is disposed on the second squeegee unit 52 to overlap with the second squeegee unit 52.

Thus, the residual ink remaining on the nozzle of the lower portion of the second scraper unit 43 is dropped on the second squeegee unit 52 instead of being dropped on the print screen 133. As a result, there is no striped stain or a contaminated area with extra ink and pearl particles. The second squeegee unit 52 may push out the ink, which is uniformly deposited on the print screen 133, to the one end of the print screen 133.

Consequently, the screen printing apparatus 100 and the screen printing method using the screen printing apparatus 100 may prevent the striped stain from being formed.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A screen printing apparatus comprising:

a print screen including a print area through which ink passes;

a scraper that provides the ink to the print screen; and a squeegee that contacts the print screen and pushes the ink through the print area, the squeegee having a first side which faces the print screen and a second side which is opposite to the first side;

wherein a lower portion of the scraper is disposed on the second side to overlap with the squeegee after the ink is coated on the print screen.

2. The screen printing apparatus of claim 1, further comprising first and second transfer units that move the scraper and the squeegee in an upper direction, a lower direction, a first direction, and a second direction opposite to the first direction in response to a signal from a control unit.

3. The screen printing apparatus of claim 2, wherein the scraper and the squeegee extend in a third direction crossing the first direction and are arranged to be spaced apart from each other, the first transfer unit is disposed at one end of the scraper and one end of the squeegee, and the second transfer unit is disposed at the other end of the scraper and the other end of the squeegee.

4. The screen printing apparatus of claim 3, wherein the scraper and the squeegee are disposed at one end of the print screen by the first and second transfer units, the scraper is transferred in the lower direction to be disposed adjacent to the print screen by the first and second transfer units and the squeegee is transferred in the upper direction by the first and second transfer units.

5. The screen printing apparatus of claim 3, further comprising:

a body;

a first frame supporter disposed on one upper end of the body;

a second frame supporter disposed on the other upper end of the body;

first and second frames extending in the first direction and arranged to be spaced apart from each other by a predetermined distance; and third and fourth frames extending in the third direction and arranged to be spaced apart from each other by a predetermined distance, wherein one end of the first frame, one end of the second frame, and the third frame are disposed on the first frame supporter, the other one end of the first frame, the other one end of the second frame, and the fourth frame are disposed on the second frame supporter, the third frame is disposed between the one end of the first frame and the one end of the second frame, and the fourth frame is disposed between the other one end of the first frame and the other one end of the second frame.

6. The screen printing apparatus of claim 5, wherein the print screen is disposed between the first frame supporter and the second frame supporter and between the first, second, third, and fourth frames.

7. The screen printing apparatus of claim 5, wherein the first transfer unit comprises:

a first horizontal transfer part connected to an inner side surface of the first frame to move back and forth along the first direction and the second direction;

a first support part connected to an upper portion of the one end of the scraper and a lower portion of the first horizontal transfer part;

a first vertical transfer part connected to an upper portion of the first horizontal transfer part to transfer the first support part to the upper and lower directions;

a second support part connected to an upper portion of the one end of the squeegee and the lower portion of the first horizontal transfer part; and a second vertical transfer part connected to the upper portion of the first horizontal transfer part to transfer the second support part to the upper and lower directions.

8. The screen printing apparatus of claim 7, wherein the second transfer unit comprises:

a second horizontal transfer part connected to an inner side surface of the second frame to move back and forth along the first direction and the second direction;

a third support part connected to an upper portion of the other one end of the scraper and a lower portion of the second horizontal transfer part;

a third vertical transfer part connected to an upper portion of the second horizontal transfer part to transfer the third support part to the upper and lower directions;

a fourth support part connected to an upper portion of the other one end of the squeegee and the lower portion of the second horizontal transfer part; and a fourth vertical transfer part connected to the upper portion of the second horizontal transfer part to transfer the fourth support part to the upper and lower directions.

9. The screen printing apparatus of claim 8, wherein the scraper comprises:

a first scraper unit connected to the first support part and the third support part and extending in the lower direction;

a second scraper unit connected to a lower portion of the first scraper unit and extending in the lower direction; and a rotation unit connected to an upper portion of the second scraper unit, and the ink is provided onto the print screen through a nozzle formed on a lower portion of the second scraper unit.

10. The screen printing apparatus of claim 9, wherein the squeegee comprises:

a first squeegee unit connected to the first support part and the third support part and extending in the lower direction; and a second squeegee unit connected to a lower portion of the first squeegee unit and inclined at a predetermined angle while extending in the lower direction, and a lower portion of the second squeegee unit is disposed to be bent to a direction in which the scraper is disposed.

11. The screen printing apparatus of claim 10, wherein, after the ink is deposited on the print screen, the first and second scraper units are transferred in the upper direction by the first and second transfer units, the first and second squeegee units are transferred in the lower direction by the first and second transfer units, the second squeegee unit makes contact with the print screen, the rotation unit rotates the second scraper unit to form a predetermined angle with respect to the second squeegee unit, and the lower portion of the second scraper unit is disposed on an upper portion of the second squeegee unit.

12. The screen printing apparatus of claim 4, wherein the scraper and the squeegee are transferred to the other end of the print screen along the first direction by the first and second transfer units and the scraper deposits the ink on the print screen while being transferred along the first direction by the first and second transfer units.

13. The screen printing apparatus of claim 12, wherein, after the ink is deposited on the print screen, the scraper is transferred in the upper direction at the other one end of the print screen by the first and second transfer units, the squeegee is transferred to the lower direction at the other one end of the print screen by the first and second transfer units to make contact with the print screen, and the lower portion of the scraper is transferred to the direction, in which the squeegee is disposed, by the control unit to be disposed on the squeegee.

14. The screen printing apparatus of claim 13, wherein the scraper and the squeegee are transferred to the one end of the print screen along the second direction by the first and second transfer units, the squeegee is transferred along the second direction to push out the deposited ink, and the ink passes through the print area.

* * * * *